United States Patent [19]

Hall

[11] Patent Number: 4,796,428

[45] Date of Patent: Jan. 10, 1989

[54] DOUBLE-ACTING FORGING HAMMER AND METHOD

[75] Inventor: Richard W. Hall, Springfield, Ohio

[73] Assignee: Oilgear Towler, Inc., Milwaukee, Wis.

[21] Appl. No.: 458,598

[22] Filed: Jan. 17, 1983

[51] Int. Cl.[4] ..... F16D 31/02

[52] U.S. Cl. ..... 60/413; 60/418; 91/5; 91/275; 91/321; 91/361; 91/417 R; 91/435

[58] Field of Search ..... 60/413, 418, 456, 414, 60/415, 416; 72/453.18, 453.01, 453.1, 443, 445, 441; 91/5, 6, 166, 275, 321, 361, 417 R, 435, 450, 31, 459, 235, 363, 398; 92/134, 144

[56] References Cited

U.S. PATENT DOCUMENTS

| | | | |
|---|---|---|---|
| 2,861,486 | 11/1958 | Brauer | 72/453.18 |
| 3,043,271 | 7/1962 | Hague et al. . | |
| 3,142,206 | 8/1964 | Hague et al. . | |
| 3,180,129 | 4/1965 | Riemenschneider et al. | 72/453.18 |
| 3,237,406 | 3/1966 | Spannhake et al. | 91/321 |
| 3,353,396 | 11/1967 | Brauer . | |
| 3,429,174 | 2/1969 | Fracke . | |
| 3,464,315 | 9/1969 | Weyer . | |
| 3,525,220 | 8/1970 | Sauerbrey . | |
| 3,587,233 | 6/1971 | Fischbach | 60/418 |
| 3,596,499 | 8/1971 | Sauerbrey . | |
| 3,596,592 | 8/1971 | Trissnak et al. . | |
| 3,683,666 | 8/1972 | Hassel . | |
| 3,727,519 | 4/1973 | Hassel . | |
| 3,818,799 | 6/1974 | Hague . | |
| 3,844,157 | 12/1974 | Bachmann . | |
| 3,932,992 | 1/1976 | Martin | 60/456 |
| 4,022,269 | 5/1977 | Segawa | 91/6 |
| 4,052,850 | 10/1977 | Mohaupt | 60/414 |
| 4,082,032 | 4/1978 | Swenson | 91/321 |
| 4,131,164 | 12/1978 | Hague et al. . | |
| 4,142,397 | 3/1979 | Heimel | 72/453.18 |
| 4,192,456 | 3/1980 | Shields et al. | 60/456 |
| 4,198,820 | 4/1980 | Roth et al. | 91/275 |
| 4,245,492 | 1/1981 | Clarke, Jr. et al. . | |
| 4,263,746 | 4/1981 | Eller et al. | 91/435 |
| 4,291,569 | 9/1981 | Breiding et al. | 72/453.18 |
| 4,335,867 | 6/1982 | Bihlmaier | 91/31 |

*Primary Examiner*—Edward K. Look

*Attorney, Agent, or Firm*—Biebel, French & Nauman

[57] ABSTRACT

A double-acting accelerated forging hammer and method of operation are disclosed. The hammer is of the type having a vertically oriented cylinder, a piston slidably mounted within the cylinder having a downwardly depending piston rod extending along the cylinder and attached to a hammer. A gas accumulator communicates with the cylinder above the piston for supplying gas under pressure thereto during a forging stroke, and a fluid accumulator communicating with the cylinder below the piston for supplying fluid thereto at a higher pressure than the gas to dirve the piston upwardly during a return stroke. A fluid tank supplies fluid to recharge the accumulator and receives fluid from the cylinder during the forging stroke. Variable valves control the rate of fluid flow from the cylinder and thereby control the rate at which the piston descends within the cylinder. In a preferred emboldiment, the gas accumulator is supplied with relatively low pressure shop air which is forced into the accumulator by repeated cycling of the piston to raise the pressure within the accumulator above that of the source of shop air.

2 Claims, 3 Drawing Sheets

DOUBLE-ACTING FORGING HAMMER AND METHOD

BACKGROUND OF THE INVENTION

The invention relates to double-acting forging hammers and, more particularly, to forging hammers actuated by pressurized gas and/or hydraulic fluid.

In its most basic form, a forging hammer consists of a frame which supports a lower die and a cylinder oriented vertically above the lower die, a piston slidably mounted within the cylinder and having a piston rod extending downwardly therefrom, a relatively large and massive hammer connected to the piston rod and mounting an upper die in registry with the lower die, and means for introducing a pressurized gas or fluid into the cylinder below the piston to raise the piston and hammer. Early forms of such forging hammers utilized steam as the pressurized gas which was introduced into the cylinder to raise the hammer. The downward force which lowered the hammer in the forging stroke consisted solely of the force resulting from the pull of gravity on the mass of the hammer, piston and piston rod.

Later embodiments of forging hammers included means for introducing steam into the cylinder above the piston to urge the piston downwardly during the forging stroke thereby accelerating the rate at which the hammer fell during the forging stroke. The force generated could exceed the force generated by a similarly sized hammer which was urged downwardly merely by the force of gravity.

However, steam-operated forging hammers possessed many disadvantages. Generating steam required the use of boilers which had to be tended by firemen and had relatively high maintenance and safety-related costs, all adding to the expense of operation. Furthermore, the steam powered hammers were relatively inefficient in that the steam evacuated from the cylinder during a forging or return stroke was typically vented to the atmosphere, resulting in a loss of energy in the form of heat from the overall system. Proper operation of such hammers required highly skilled and trained operators who had learned how to control the steam or air valves to achieve just the right impact force.

Subsequent forging hammers utilized pneumatic or hydraulic systems in which a compressible gas or a hydraulic fluid was forced into the cylinder by pumps in place of steam. A disadvantage of pneumatic systems, such as that disclosed in Weyer U.S. Pat. No. 3,464,315, is that at least a portion of the air is exhausted to the atmosphere at the end of the forging and/or return strokes, requiring the pumps to generate additional compressed air and decreasing the overall operating efficiency of the system. Another disadvantage of such systems is that relatively high pressure air must be generated, requiring heavy duty compressors which add to the cost of the system.

Hydraulic systems, such as that disclosed in the Hassel U.S. Pat. No. 3,727,519, were typically closed systems in which hydraulic fluid would be stored in a reservoir and supplied to the cylinder by pumps to move the piston. At the same time, the hydraulic fluid within cylinder which was not acting on the piston therein would be evacuated from the cylinder and would flow back to the reservoir. A disadvantage of such systems is that they required complex components and extensive piping, which add to the overall cost of the system.

Accordingly, there is a need for a double-acting forging hammer which utilizes pneumatic and/or hydraulic hammer driving systems, yet does not have the energy losses associated with pneumatic systems or the complex and sophisticated components of hydraulic systems. Furthermore, there is a need for a pneumatic and/or hydraulic hammer driving system which can be retrofitted easily to existing forging hammers.

SUMMARY OF THE INVENTION

The present invention provides a double-acting forging hammer and method in which the hammer is urged downwardly and is accelerated in the forging stroke by compressed gas delivered to the cylinder above the piston from a gas accumulator, and the piston is urged upwardly in a return stroke by hydraulic fluid supplied by a fluid accumulator such that the gas is evacuated from the cylinder to the gas accumulator where it is stored for reuse during the next forging stroke of the hammer. Thus, the compressed gas supplied to the cylinder is reused and not vented to the atmosphere, thereby increasing the overall efficiency of the system. Another advantage of the present invention is that a hydraulic system is utilized only to displace the piston upwardly during the return stroke and is not used to urge the piston downwardly during the forging stroke. Therefore, the hydraulic system requires fewer components and is less expensive to fabricate and maintain than prior hydraulic systems which urge both the piston and the hammer upwardly and downwardly.

The present invention is used with a double-acting forging hammer of the type having a vertically oriented cylinder, a piston slidably mounted within the cylinder having a downwardly depending piston rod extending along the cylinder and attached to a hammer, and a housing or frame for supporting the cylinder and including a die or dies associated with the hammer. The invention includes a gas accumulator which is connected to introduce a gas under pressure into the cylinder above the piston to urge the piston, rod and hammer downwardly in a forging stroke, and a fluid accumulator connected to introduce hydraulic fluid at a relatively higher pressure into the cylinder below the piston to urge the piston, rod and hammer upwardly in a return stroke, simultaneously causing gas within the cylinder to be evacuated therefrom and forced back to the gas accumulator. The invention includes a hydraulic fluid holding tank and a pump for pumping fluid from the tank to charge and maintain the fluid accumulator at the proper pressure.

During the forging stroke, compressed gas, for example nitrogen, within the gas accumulator flows into the cylinder above the piston and urges the piston and hammer downwardly with a substantially constant force. At the same time, an adjustable and controllable valve is opened to permit the hydraulic fluid below the piston to flow from the cylinder to the holding tank. By controlling the opening and the closing of the valve and the rate of flow of hydraulic fluid through the valve, the rate at which the hammer falls during the forming stroke, and therefore the impact energy, may be precisely controlled.

In another preferred embodiment, the gas accumulator and cylinder communicate with a source of shop air at a relatively lower pressure which is used to charge the gas accumulator. Air from the source of shop air is drawn into the cylinder during a downward movement of the piston, then forced from the cylinder to the accumulator by a subsequent upward movement of the piston; the supply line from the source of shop air includes a check valve to prevent the compressed gas from flowing back to the source. By repeated cycling of the hammer, the gas accumulator is "pumped up" by the piston with air from the source of shop air to a suitable operating pressure.

Also in the preferred embodiments, the fluid supply tank is mounted on top of the forging hammer housing and surrounds the cylinder and gas accumulator. The hydraulic system, consisting of the pump and attendant motor, fluid accumulator, and requisite valves, can be mounted alongside the fluid supply tank. Thus, the present invention is ideally suited for retrofitting existing forging hammers. In addition, by mounting the gas accumulator within the fluid supply tank, the fluid receives heat from the gas accumulator such that a cooling system for cooling fluid also cools the gas accumulator, and the gas therein is maintained at a substantially constant temperature.

The present invention is also well-suited for fully automatic operation. In such an application, the invention includes a transducer associated with the piston and cylinder which senses the position of the piston within the cylinder and generates a responsive signal to a microprocessor. The microprocessor can be programmed to actuate the hydraulic valves such that a series of hammer blows can be effected, each with an individually predetermined stroke height, velocity and blow energy. With such an automated system, an operator need not possess mechanical skill in order to control the stroke and force of repeated hammer blows.

Accordingly, it is an object of the present invention to provide a forging hammer and method of operating the same which utilize an efficient, completely closed pneumatic system to accelerate the hammer during the forging stroke; which utilize an efficient hydraulic system both to displace the piston and hammer upwardly for the return stroke and control the rate at which the hammer falls during the forging stroke; which can be retrofitted easily to existing forging hammers; and which can be adapted to utilize microprocessors for fully automated operation.

Other objects and advantages of the invention will be apparent from the following description, the accompanying drawings and the appended claims.

DESCRIPTION OF THE PREFERRED EMBODIMENTS

Figure 1:
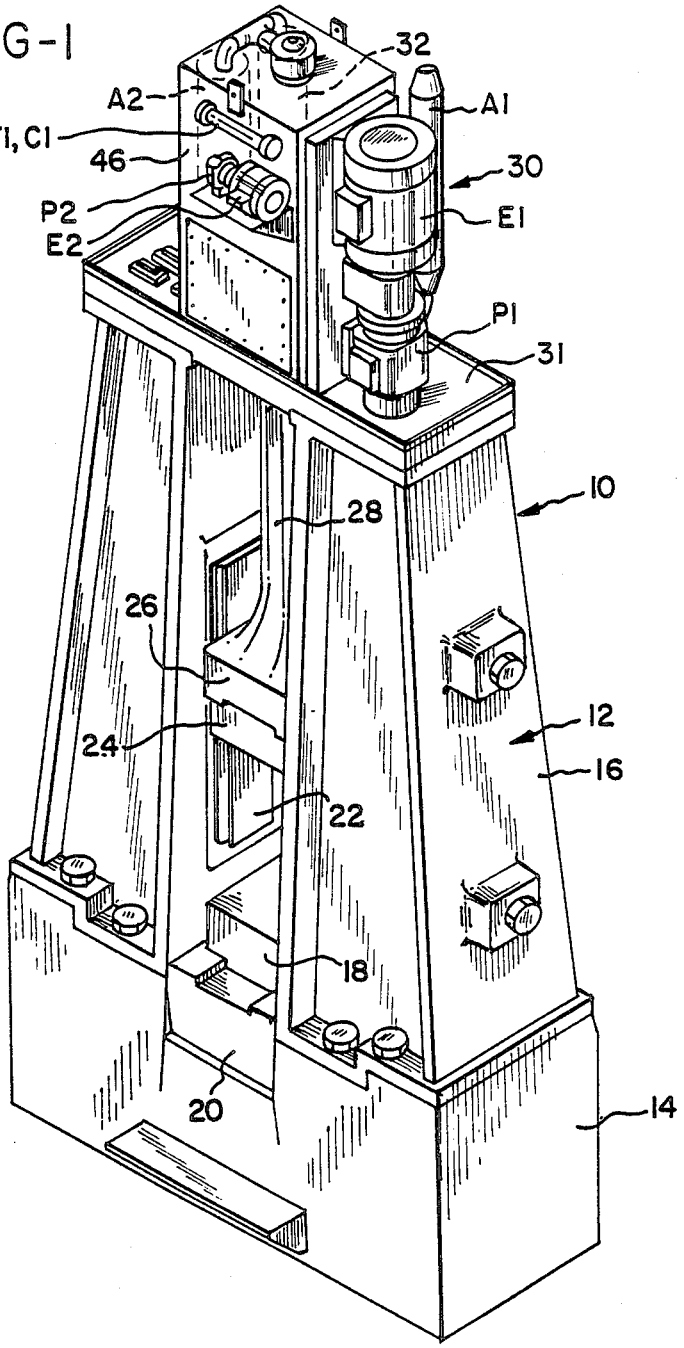
FIG. 1 is a perspective view of the double-acting forging hammer of the preferred embodiment.

As shown in FIG. 1, the double-acting forging hammer of the present invention, generally designated 10, includes a frame 12 having a base 14 with a ram support structure 16. The base 14 also includes a lower die 18 slidably mounted or keyed to a die shoe 20. The ram support structure 16 includes a guide 22 which slidably receives an upper die 24. The upper die 24 is attached to a hammer 26 which is supported on a piston rod 28.

Figure 2:
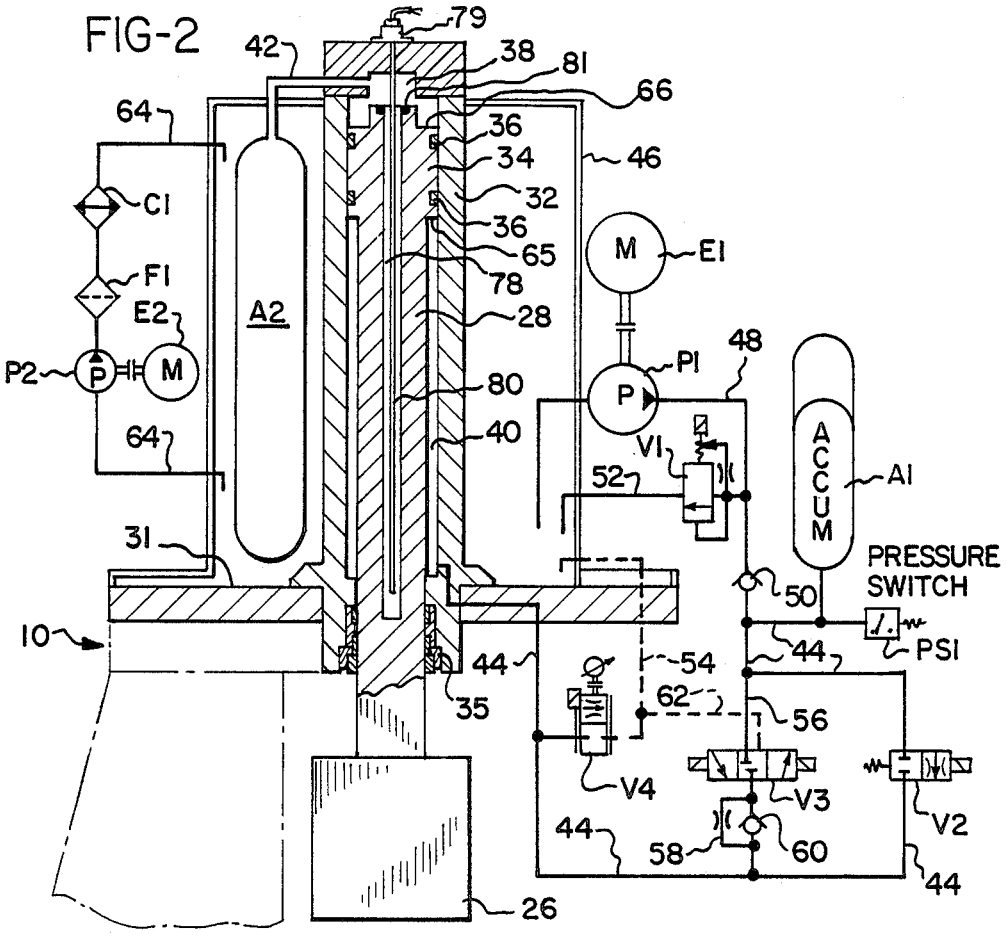
FIG. 2 is a somewhat schematic detail of the upper portion of the hammer of FIG. 1 in which the cylinder, piston, and a portion of the hammer housing are in section.

The hammer 26 and upper die 24 are actuated by a pneumatic-over-hydraulic system, generally designated 30, which is mounted to a top plate 31 of the ram support structure 16. As shown in FIGS. 1 and 2, the pneumatic-over-hydraulic system 30 includes a cylinder 32, having a piston 34 which is integrally joined to the piston rod 28. The piston rod 28 is preferably integral with the piston 34 and extends through the cylinder 32 at fluid packing 35. The piston 34 is slidably mounted within the cylinder 32 and includes seals 36 to prevent the leakage of compressed gas or fluid across the surface of the piston. The piston 34 thus divides the cylinder into an upper chamber 38 and a lower annular chamber 40. The upper annular chamber communicates with a gas accumulator A2 by a gas supply line 42. Accumulator A2 preferably is charged with an inert gas such as nitrogen to a pressure of about 350 psi.

The lower annular chamber or annulus space 40 communicates with a hydraulic fluid accumulator A1 through fluid supply line 44. The fluid line 44 includes a solenoid actuated valve V2 which starts and stops fluid flow through the supply line. The fluid accumulator A1 preferably is charged with hydraulic fluid to a pressure of approximately 5,000 psi.

A fluid supply tank 46 is mounted to the top plate 31 of the ram supply structure and encloses the cylinder 32 and accumulator A2. A motor E1 drives a hydraulic pump P1 mounted on line 48 to pump hydraulic fluid from the tank 46 to supply line 44 where it flows into the accumulator A1 to charge it. A check valve 50 is located on line 48 to prevent backflow of hydraulic fluid from the accumulator A1 to the tank 46. A pressure switch PS1 is located on line 44 to prevent the accumulator A1 from becoming overcharged by the pump P1. Should the pressure in the accumulator A1 exceed a predetermined level, pressure switch PS1 actuates overflow valve V1 on overflow line 52 so that the fluid in line 48 is dumped back to the tank 46.

Hydraulic fluid is evacuated from the lower annular chamber 40 through exhaust line 54 which extends from line 44, downstream of valve V2, to the fluid supply tank 46. An adjustable, infinitely positionable valve V4 is located on exhaust line 54 and can be adjusted to vary the flow of fluid through the exhaust line. Adjustable valve V4 may be any one of a number of proportionally adjustable valves, such as the solenoid valve disclosed in Cowan U.S. Pat. No. 3,725,747, or the flow control valve of Scheffel U.S. Pat. No. 4,311,296, the disclosures of which are incorporated herein by reference. While a proportionally operable valve V4 is shown, it is within the scope of this invention to use any suitable form of a controllable valve, such as a stepping motor-controlled valve, for adjusting the rate of flow of hydraulic fluid from the annulus space, to control the rate of fall of the hammer 26.

A bypass line 56 extends in parallel with valve V2 on line 44 and includes a three-way solenoid actuated valve V3. In series with valve V3 is a combination fixed fluid restrictor 58 and check valve 60. Valve V3 is shown in a closed position in FIG. 2, thereby preventing fluid through line 56. In a first position, in which the spool of valve V3 shown in FIG. 2 is displaced to the right, the valve opens to allow fluid flow from the accumulator A1 through lines 44 and 56 to the lower annular chamber 40 of the cylinder 32. When the spool is displaced to the left, fluid flow is directed from the annular chamber 40, through line 44, and back to the fluid supply tank 46 through auxiliary exhaust line 62 and exhaust line 54. Fluid flow in this reverse direction must pass through the fluid restrictor 58. Preferably valve V3 is undersized relative to valve V2 such that use of valve V3 enables the operator to displace the piston 34 more slowly than with valves V2 and V4.

The fluid within the tank 46 is drawn through a recirculating line 64 by a pump P2 driven by an electric motor E2. Recirculating line 64 includes a filter F1 and heat exchanger C1. Thus, operation of the pump P2 draws fluid from the tank 46 through line 64 where it is filtered and cooled, then is returned back to the tank.

The annular working area 65 of the underside of piston 34 is relatively small as compared to the area of the top 66 of the piston exposed to the upper space 38, preferably at a ratio of at least 1:6. Thus, there is a minimum of hydraulic fluid to be displaced to and from the space 40 during the cycle of operation. Since there is only a small amount of liquid or hydraulic fluid to be displaced, valves V2 and V4 provide only a minimum of back pressure and a minimum of effective area over which the back pressure would be effective.

For example, for the aforementioned minimum ratio of 1:6, 1 psi of back pressure during discharge of the hydraulic fluid would have 1/6 the effective force of 1 psi of gas pressure on the top of the piston 34. Since the amount of fluid which must be displaced is thus held to a minimum, the losses in energy are similarly held to a minimum. Valving of moderate size may be used without creating undue back pressure or restrictions. Accordingly, terminal velocities of 300" per second or more in the rate of fall of the hammer can be readily achieved, thus permitting a maximum amount of force to be directed to the work piece between the dies, where such is required.

To operate the forging hammer 10, the fluid and gas accumulators A1,A2, respectively, are first charged with hydraulic fluid and nitrogen gas. Because the gas accumulator A2 and upper chamber 38 are essentially a closed system, there is no need to recharge the accumulator before each period of use. The fluid accumulator A1 is charged by the pump P1 which is powered by electric motor E1 to pump hydraulic fluid through lines 48 and 44 to the accumulator. Once the fluid pressure within the accumulator A1 has reached the desired level, typically up to 5,000 psi, the pressure switch PS1 opens valve V1 to dump the fluid back to the tank 46 through overflow line 52.

Typically, the hammer 26 is in a lowered position prior to system operation. To raise the hammer, valve V2 is opened, allowing fluid to flow from accumulator A1 through line 44 to the lower annular chamber 40. The fluid expands against the underside of piston 34 and urges the piston upwardly, thereby drawing the hammer 26 upwardly with it. At the same time, the volume of the upper chamber 38 is decreased, forcing gas back into accumulator A2. Valve V2 is closed and the system is ready for the forging operation.

To initiate the downward movement of the hammer 26 in a forging stroke, valve V4 is opened a predetermined amount, allowing fluid within the annular chamber 40 to flow through line 44 and exhaust line 54 back to the tank 46. Since the valve V4 is adjustable, the flow rate of fluid through these lines can be maintained at a predetermined rate, thereby controlling the rate at which the piston 34 descends wihtin the cylinder 32. Fluid flow back to the accumulator is prevented by valves V2 and V3 which are closed during this portion of the hammer operation. The downward movement of the piston 34 and hammer 26 is accelerated by the force exerted on the upper surface of the piston by the gas entering the upper chamber 38 from the gas accumulator A2. The volume of the accumulator A2 preferably is relatively great as compared to the total displacement of the piston 34 in the cylinder so that gas pressure on the piston decreases very little during downward movement, and in fact may be considered as being relatively constant during operation.

Near or at the bottom of the forging stroke, valve V4 is closed and valve V2 is opened, allowing fluid once again to enter the lower annular chamber 40. For example, valve V4 may be signalled to close just prior to die impact, to control rebound. Although the surface area of the piston 34 against which the fluid acts in annular chamber 40 is substantially less than the surface area of the piston against which the gas acts in upper chamber 38, the fluid easily displaces the piston 34 upwardly and forces the gas back into the accumulator A2 because the fluid is at a much higher pressure than the gas. In contrast, the fluid pressure within the supply tank 46 is at a much lower pressure than the gas within the accumulator A2, enabling the fluid to be evacuated from the annular chamber 40 by the force of the expanding gas within the upper chamber 38 and the weight force of the hammer 26. Since fluid evacuated from the lower chamber 40 is returned to the tank 46 during the forging stroke, the pump P1 is operated continuously to maintain the accumulator A1 at the proper pressure and volume.

For setting the forging hammer 10 for operation in the aforementioned manner and for loading in the die sets, it is often necessary to produce very slow upward and downward movements of the hammer 26. For example, the top and bottom of the hammer stroke must be determined with accuracy. To accomplish such a slow movement easily, the valve V3 on bypass line 56 is utilized to permit fluid flow to and from the lower chamber 40 at a much slower rate. Fluid flow from the accumulator A1 to the lower chamber 40 through valve V3 and check valve 60 is reduced because of the relatively smaller size of valve V3 in comparison to valve V2. Fluid flow from the chamber 40 back to the supply tank 46 is reduced even further because the fluid flows through fixed restriction 58 as well as valve V3.

In both aforementioned modes of operation, the pneumatic portion of the system acts as a spring. As the piston 34 travels upwardly, the gas is compressed in the upper chamber 38 and forced back to the accumulator A2. The dumping of fluid from lower chamber 40 through valve V4 and back to supply tank 46 enables the gas to reenter the upper chamber 38 and expand against the piston 34 and accelerate the downward movement of the hammer 26. Thus, the pneumatic system does not require pumps or valves, and greatly reduces the overall cost of fabrication and maintenance of the forging hammer 10. Another advantage of this pneumatic system is that the gas accumulator A2 is located within the fluid supply tank so that heat generated by the compression of the gas or friction of gas flow may pass through the walls of the accumulator A2 to be absorbed by the fluid within the tank 46 where it can be cooled by passage through the heat exchanger C1 on line 64. Of equal importance is the fact that the hydraulic fluid in the tank 46 will be maintained, in use, at a relatively constant temperature and will thus provide a correspondingly constant temperature bath for the accumulator A2, thereby transferring or receiving heat from the accumulator to reduce variations in gas pressure due to variations in temperature within the accumulator.

Figure 3:
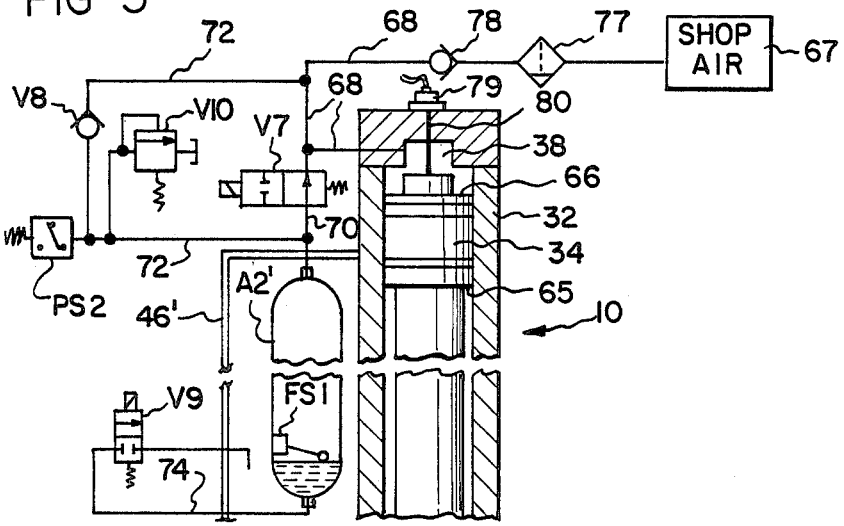
FIG. 3 is a somewhat schematic detail of an alternate embodiment of the pneumatic system of the invention in which the cylinder is in section.

An alternate embodiment of the pneumatic system is shown schematically in FIG. 3. The upper chamber 38 of the cylinder 32 is joined to a source 67 of relatively low pressure shop air by supply line 68. A branch 70 of supply line 68 extends to accumulator A2' and includes valve V7. A bypass line 72 extends from line 68 to line 70 and is oriented in parallel with valve V7. Bypass line 72 includes a check valve V8 and a pressure relief valve V10 which is signalled by pressure switch PS2. The pneumatic system is further modified in that the gas accumulator A2' includes a fluid drain line 74 which extends from the bottom of the accumulator to the fluid supply tank 46'. A float switch FS1 is mounted within the accumulator A2' and actuates a valve V9 on line 74.

To operate the modified system shown in FIG. 3, the spool of valve V7 is moved to the right blocking flow from line 68 to line 70 and the piston 34 is lowered within the cylinder 32 in a manner previously described, thereby expanding the volume of the upper chamber 38. This expanding volume is filled with shop air from the source 67 along line 68 through air dryer 77 and check valve 78. A return stroke of the hammer 26 in the manner previously described causes the piston 34 to move upwardly, thereby forcing the air within the upper chamber 38 back through line 68 and through the bypass line 72 and check valve V8 where it enters the accumulator A2'. Air is prevented from traveling back through supply line 68 by check valve 78. This cycle of operation is repeated, and each time the air within the upper chamber 38 is forced through lines 68 and 72 to the accumulator A2'. The pressure of the air within accumulator A2' is thus gradually increased or "pumped up" until it reaches a predetermined operating pressure, typically not more than 350 psi. The accumulator A2' is prevented from being overcharged by the relief valve V10 which vents the shop air to the atmosphere in response to a signal from pressure switch PS2.

After this charging sequence has been completed, the forging hammer 10 is ready for operation in the manner described in relation to FIGS. 1 and 2. Valve V7, which was closed during the charging sequence, is now opened to allow compressed air to flow through lines 70 and 68 to the upper chamber 38. The gas is prevented from flowing through lines 72 and 68 by check valves V8 and 78, respectively.

Figure 4:
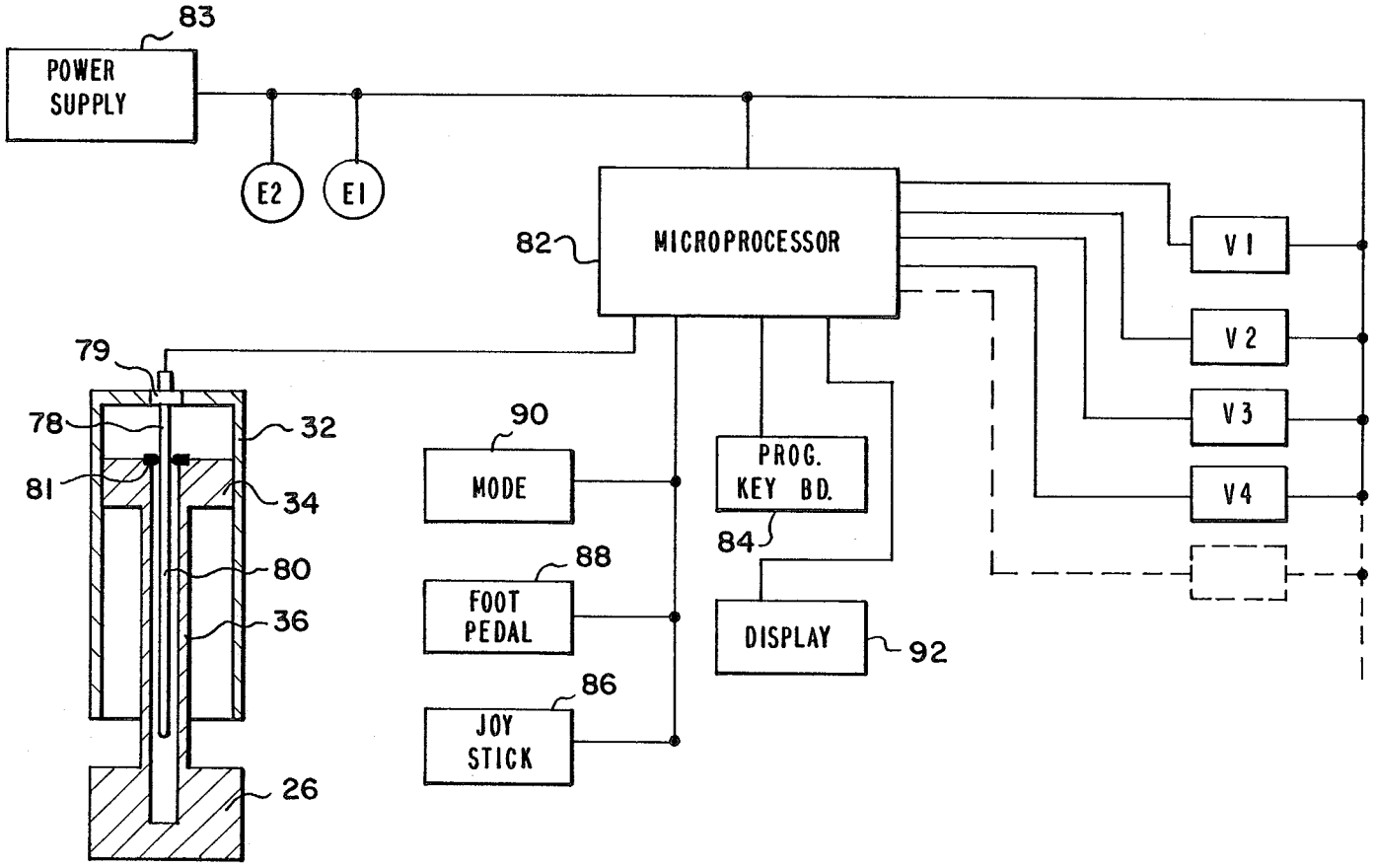
FIG. 4 is a schematic of the circuit diagram of an alternate embodiment of the invention.

For fully automatic use, a system such as that shown schematically in FIG. 4 is incorporated into the invention. The cylinder 32 (also shown in FIGS. 2 and 3) mounts a linear displacement transducer 79 or similar electrical devices which includes a shaft 80 extending downwardly through the cylinder, piston 34, and piston rod 36. The transducer 79 includes a magnetic ring 81 which is mounted to the piston 34 such that the ring moves with the piston. Transducers of this type are well-known, an example of which is the linear displacement transducer, series DCTM, manufactured by Temposonics, Inc., Plainview, N.Y.

The transducer 79 generates a signal which varies in response to the position of the piston 34 within the cylinder 32, and hence the position of the hammer 26 relative to the lower die 18 (FIG. 1), to a microprocessor 82. The microprocessor 82 is driven by a power supply 83 which also powers the electric motors E1 and E2 which drive the fluid pumps P1 and P2 (FIG. 2), and supplies power to the electric solenoids of valves V1, V2, V3, V4, V7, and V9. The microprocessor 82 preferably is of modular design and is progammable by means such as a keyboard 84. In addition, the microprocessor can be programmed to respond to manual inputs such as a joystick 86 or a foot pedal 88. A mode selection switch 90 is used to switch on the system, switch the system from fully automatic to fully manual, or to switch the system to "inch" the hammer 26 upwardly or downwardly during a setting up period (thereby actuating valve V3).

During operation, the central processing unit of the microprocessor unit interrogates the input from the transducer 79 and determines when the hammer slows down or stops and at that time effects a return stroke. The microprocessor also interrogates the input signals generated from a predetermined program and actuates the solenoids of the valves in the proper sequence. The microprocessor 82 can be programmed to display pertinent information on a cathode ray tube 92 or other display means. By utilizing the programming keyboard 84, an operator can preset the topmost and lowermost positions of the hammer during a forging stroke. By controlling the length of the stroke, the ultimate force delivered to the workpiece is controlled. In addition, the valve V4 (FIG. 2) which is adjustable, can be actuated by the microprocessor 82 to open gradually and close gradually, thereby enabling the hammer 26 to be brought against the workpiece at a first velocity, then slowed as the hammer makes contact with the workpiece as the valve is gradually closed. Furthermore, the microprocessor 82 may be programmed by the keyboard 84 to deliver a sequence or series of hammer blows in which each blow is different in stroke and force from the blow preceding or succeeding it.

The invention further includes means for detecting the rate of change of velocity of the hammer 26 as it falls. The rate of change may be detected by differentiating a signal from the transducer 79, or by differentiating any other signal which may readily be derived relating to the rate of movement of the hammer, and utilizing this signal within the control system for providing an indication of the time when the hammer is slowing down or when the hammer stops. Thus, an operator may, for example, work with a long stroke and not enter return signal data, and the stopping of the hammer may be detected and used to operate the return valve V2.

While the forms of apparatus and method herein described constitute preferred embodiments of this invention, it is to be understood that the invention is not limited to these precise forms of apparatus and method, and that changes may be made therein without departing from the scope of the invention.

What is claimed is:

1. A double-acting accelerated forging hammer in which a vertically movable hammer ram is mounted on a hammer frame, for imparting a predetermined and controlled amount of blow energy in said ram, comprising:

a cylinder having a rod and piston therein defining a closed end above said piston and an annulus region between the cylinder and said piston rod, means connecting said rod to said ram, a source of hydraulic fluid, a high pressure hydraulic pump connected to draw hydraulic fluid from said source, a hydraulic accumulator connected to receive hydraulic fluid under high pressure from said pump, pressure switch means connected to maintain said hydraulic accumulator at a predetermined high fluid pressure, a gas accumulator having a substantial volume compared to the volume in said cylinder at said closed end for storing a quantity of gas under pressure with said gas at a substantially lower pressure than that of hydraulic fluid in said hydraulic accumulator for applying a relative constant bias to said piston to provide a relatively uniform acceleration to said ram, means connecting said gas accumulator to said cylinder closed end, first controllable valve means for applying fluid under pressure from said hydraulic accumulator to said annulus region, variable valve means connected to exhaust fluid from said annulus region to said source at a controlled rate to allow the fall of said ram under the influence of gravity and said gas pressure on said piston, and control means, including means responsive to the position of said ram, for closing said first valve means at a given ram elevation, for opening said variable valve means providing for the fall of said ram, and thereafter for closing said variable valve means and opening said first valve means to apply pressure from said hydraulic accumulator to said annulus to effect a rapid rise in hydraulic pressure therein for controlling rebound and reinitiating upward movement of said ram, and said control means closes said variable valve means just prior to ram impact and immediately thereafter opens said first valve means, to control rebound of the ram.

2. A method of operating a double-acting forging hammer of the type in which a piston is operatively connected to a hammer by a piston rod and reciprocates within a substantially vertical cylinder, such that downward movement of the piston causes the hammer ram to move downwardly in a forging stroke, and upward movement of the piston causes the ram to more upwardly in a return stroke, comprising the steps of:

providing a signal which is proportional to the position of said piston in said cylinder, introducing a gas into the cylinder above the piston under relatively constant pressure to urge the piston downwardly in a forging stroke direction with a generally uniform acceleration, introducing hydraulic fluid under pressure in the cylinder below the piston, to bring said piston up to a predetermined raised position in said cylinder in accordance with the blow energy required, with a controllable valve, permitting escape of said hydraulic fluid from the cylinder at a controlled rate as the piston travels downwardly under the influence of gravity and said gas pressure, thereby controlling the rate of drop of said ram, monitoring said signal to sense arrival of said piston at the down end of the stroke of the hammer indicating impending contact of the ram with a workpiece, and introducing hydraulic fluid to said cylinder beneath said piston from hydraulic accumulator means at relatively high pressure to cause a correspondingly sudden increase in pressure within said cylinder, to control bounce and to return said piston to its said predetermined raised position.

* * * * *